United States Patent [19]

Mayer

[11] Patent Number: 4,703,676

[45] Date of Patent: Nov. 3, 1987

[54] RATCHET WRENCH WITH MULTIPLE TOOLS

[76] Inventor: Albin F. Mayer, 2920 Pilot Knob Rd., Eagan, Minn. 55121

[21] Appl. No.: 842,213

[22] Filed: Mar. 21, 1986

Related U.S. Application Data

[63] Continuation-in-part of Ser. No. 765,364, Aug. 13, 1985, Pat. No. 4,592,255, which is a continuation of Ser. No. 563,998, Dec. 21, 1983, abandoned.

[51] Int. Cl.[4] ..... B25B 13/46

[52] U.S. Cl. ..... 81/63; 81/60

[58] Field of Search ..... 81/60–63.2

[56] References Cited

U.S. PATENT DOCUMENTS

| | | | |
|---|---|---|---|
| 193,301 | 7/1877 | Vassar . | |
| 455,133 | 6/1891 | Thring | 81/62 |
| 625,149 | 5/1899 | Crocker | 81/63 |
| 837,537 | 12/1906 | Beyer | 81/62 |
| 864,007 | 8/1907 | Lyon . | |
| 896,607 | 8/1908 | Zeller . | |
| 915,446 | 3/1909 | Kearnes . | |
| 1,012,881 | 12/1911 | Marsh . | |
| 1,350,315 | 8/1920 | Katzmarek | 81/60 |
| 1,391,677 | 9/1921 | Foss . | |
| 2,058,855 | 10/1936 | Chapman . | |
| 3,967,514 | 7/1976 | Deutch . | |
| 4,308,768 | 1/1982 | Wagner | 81/60 |

*Primary Examiner*—Frederick R. Schmidt
*Assistant Examiner*—Debra S. Meislin
*Attorney, Agent, or Firm*—Paul L. Sjoquist

[57] ABSTRACT

A handle member having at least one circular opening proximate an end, and having a ratchet pawl engageable proximate the opening, and having a spring biased link engageable into and out of the opening, and also engageable against the ratchet pawl for disengaging the ratchet pawl when the link is disengaged from the opening, and including a plurality of tools having a generally cylindrical construction for insertion into the opening, each tool having a surface thereabout for engagement of the link against the tool surface wherein the link holds the tool in the handle and permits ratcheting wrench action, and disengagement of the link also disengages the ratchet pawl and permits the tool to be released from the handle opening.

11 Claims, 12 Drawing Figures

Fig. 1
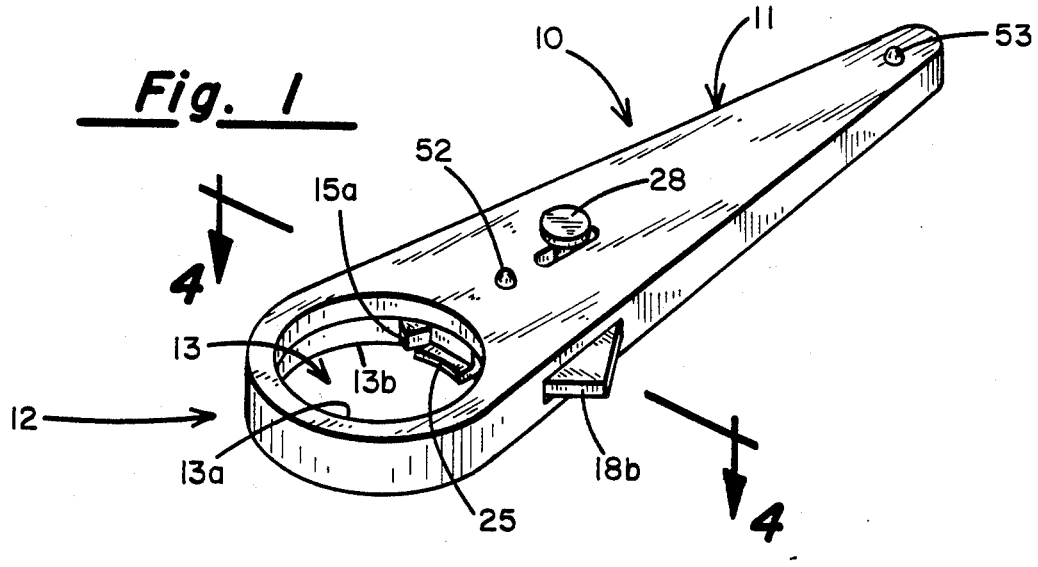
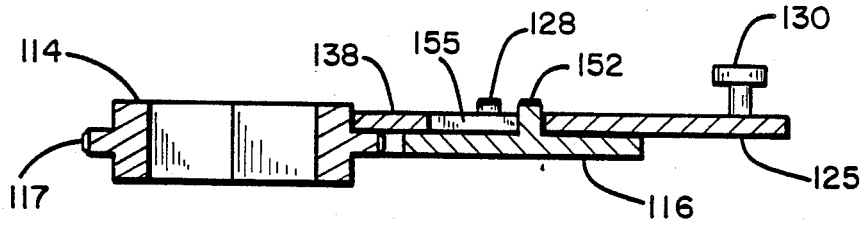
Fig. 6C
Fig. 2A
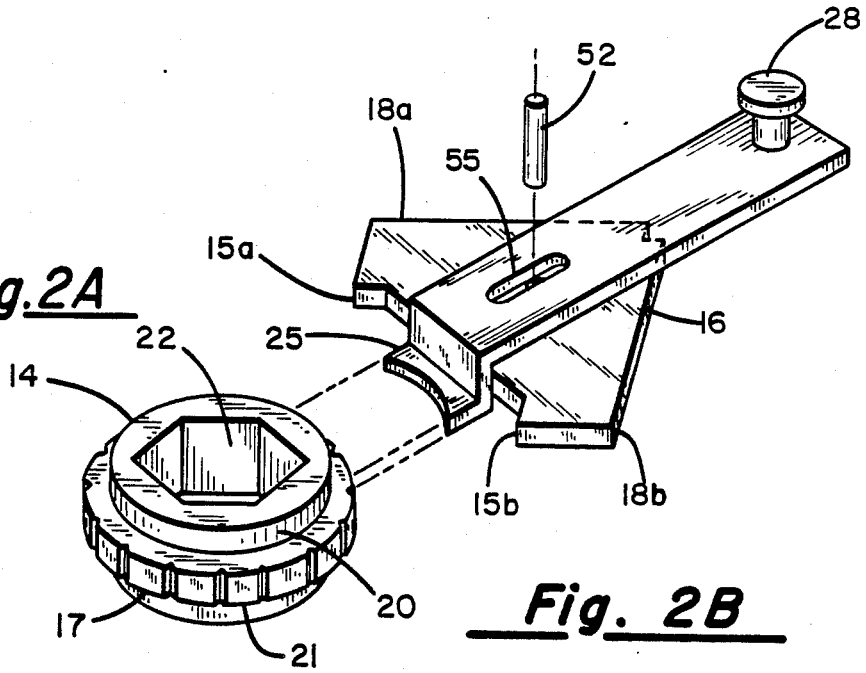
Fig. 2B

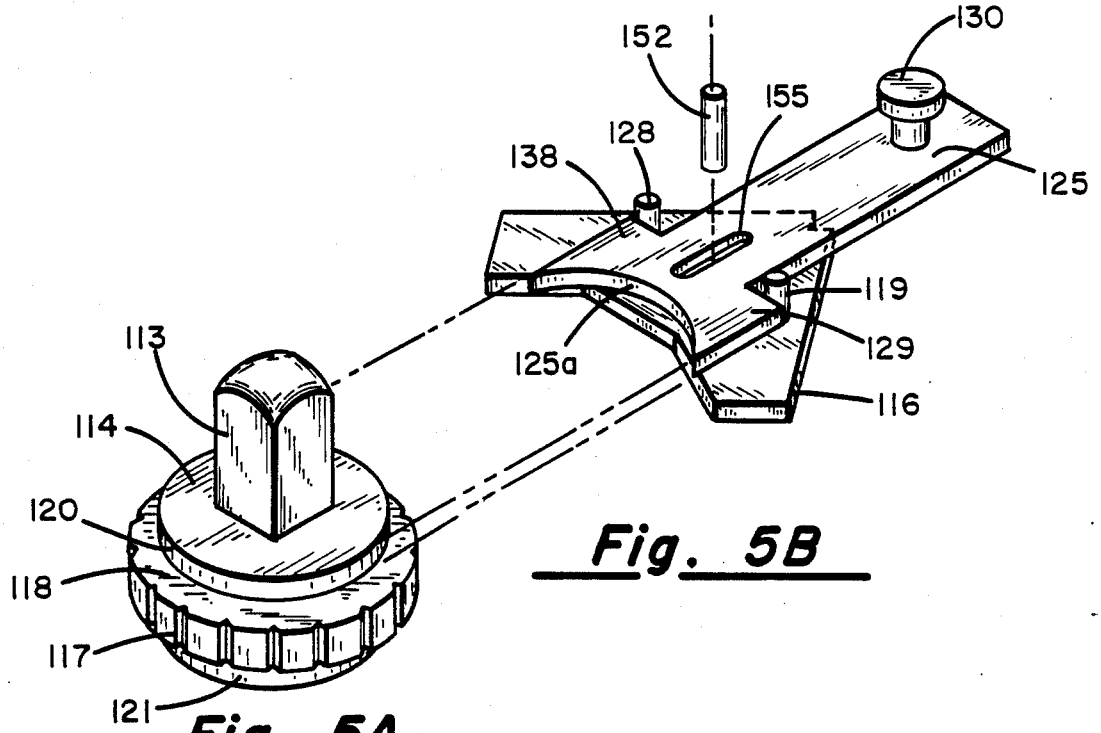
Fig. 5B
Fig. 5A
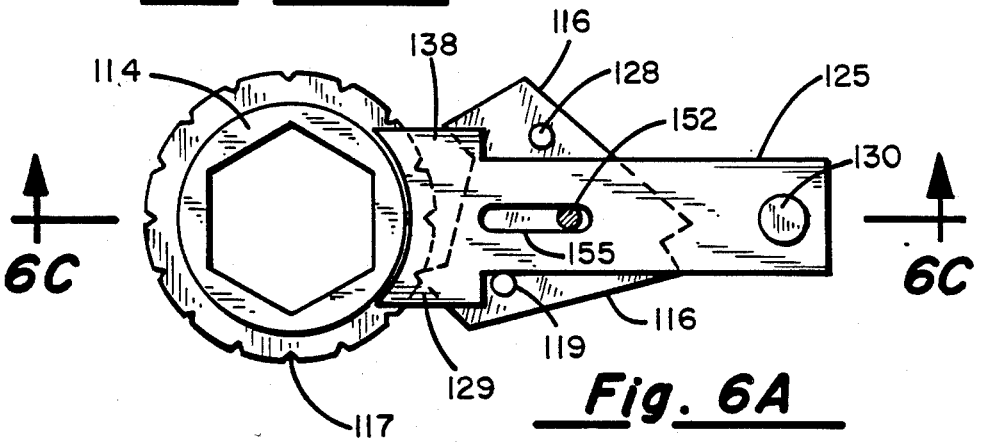
Fig. 6A
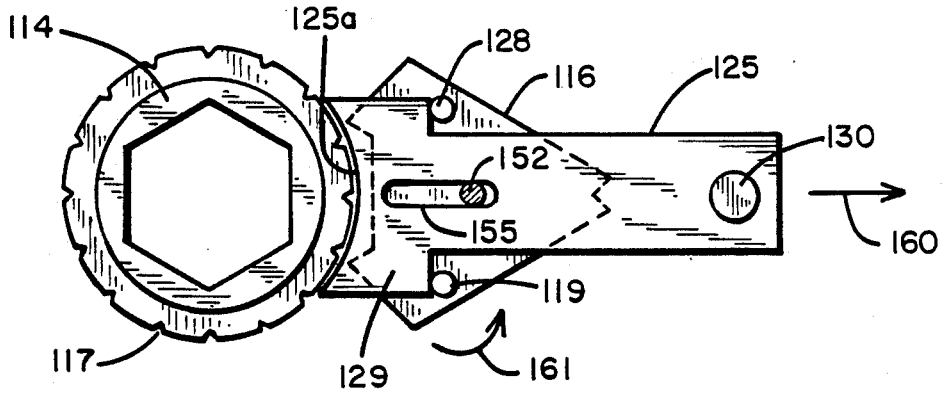
Fig. 6B

RATCHET WRENCH WITH MULTIPLE TOOLS

This is a continuation-in-part of Ser. No. 765,364, filed Aug. 13, 1985, now U.S. Pat. No. 4,592,255, which was a continuation of Ser. No. 563,998, filed Dec. 21, 1983, abandoned.

BACKGROUND OF THE INVENTION

This invention relates generally to tools having ratchet drive action, such as wrenches and the like, and more particularly to ratchet wrenches of the type having a single handle engageable with a plurality of tools for delivering a ratchet drive action.

The prior art shows a wide variety of ratchet wrench devices, including ratchet wrench devices having multiple tools attachable thereto. The most commercially successful wrenches of this general class have been the well-known socket wrench combinations, wherein a plurality of sockets are constructed for accommodating different nut sizes, each of them having a common size opening, usually square, for insertion into a ratchet handle having a projecting square shank. Such wrenches are widely used throughout the world in a wide variety of sizes. In the United States, socket wrenches are commonly sold having ⅛-inch, ¼-inch, ⅜-inch and ½-inch shanks as drive members, with socket sets designed to accommodate these drive shanks. Further, a large number of adapters of various types have been developed for attachment to drive shanks on wrenches of this type, in order to more readily accommodate the wrenches to different work situations.

A second general class of ratchet wrenches which have been widely accepted are box end wrenches having a ratcheting insert proximate one or both ends of a wrench handle. These wrenches are typically characterized by a handle member having a different sized ratcheting nut receiving tool proximate each end of the handle, wherein the nut receiving tools are permanently mounted in the handle. This class of wrenches usually requires a handle for each different pair of nut receiving tools, and thereby necessitates a collection of handles in order to accommodate a wide range of nut sizes. The advantage of this class of wrenches ove the typical socket wrench is in that they are generally constructed with a narrow profile and are therefore more accessible into small openings for access to nuts which are hard to reach. The disadvantage of this class of wrench is that each handle will accommodate only two nut receiving tools, and therefore a workman must acquire a collection of these wrenches in order to effectively work on a wide variety of nut and bolt sizes. The ratchet mechanism for this class of wrench is typically uni-directional, requiring that the wrench be turned to one side or the other, depending upon whether a nut is to be loosened or tightened.

Common socket wrenches typically require two hands for inserting and removing the tool from the wrench drive mechanism. Some socket wrenches have a button-actuated spring-loaded detent which may be depressed with one hand, while the other hand readily removes the socket tool, while the other socket wrenches require the removal of the tool by pulling it away from a spring-loaded detent mounted in the drive shank. In either case, two hands are required for this operation. Conversely, common socket wrenches suffer from the further disadvantage that on occasion the tool becomes separated from the drive mechanism by becoming jammed against a nut or bolt during use. In these cases it becomes necessary to forcefully remove the tool from its jammed position after the handle drive mechanism has slipped from engagement with the tool.

There is a need for a ratchet wrench mechanism which avoids the disadvantages summarized above, wherein the tool may be engaged and disengaged from the wrench with a one-hand operation, and wherein the tool is positively locked into engagement with the handle drive mechanism during use so that there is no way for the tool to become disengaged or separated from the handle mechanism unless the operator intends such disengagement to occur. Further, there is a need to provide a ratchet mechanism having the relatively thin profile of the second type of ratchet wrench described above, while at the same time having the capability of accepting multiple tools as describe with reference to the socket wrench style summarized above.

It is therefore a principal object of the present invention to provide a ratchet drive member capable of ratcheting operation, and which is usable with a plurality of tools which may be readily engaged and disengaged from the handle.

It is a further object of the present invention to provide a ratchet drive mechanism and tool combination which is amenable to one-hand operation.

It is a further object of the present invention to provide a ratchet drive handle mechanism which is adaptable for operation with socket tools of the type commonly used in commerce.

SUMMARY OF THE INVENTION

The present invention includes a handle drive mechanism having a ratchet pawl incorporated therein, the handle drive mechanism having at least one circular opening proximate an end thereof, wherein the ratchet pawl is engageable proximate the opening, and wherein a tool engagement link is selectively engageable into the opening, the engagement link being mechanically connected to the ratchet pawl mechanism for pivotally moving the ratchet pawl into disengagement when the link is disengaged from the opening, and further comprising a plurality of tools, each tool having a generally cylindrical shape for insertion into the opening, and having a raised circumferential shoulder having teeth sized for engagement by the ratchet pawl, and having a bearing surface engageable by the engagement link.

BRIEF DESCRIPTION OF THE DRAWINGS

The foregoing objects and advantages of the invention are disclosed in the specification hereto, and with reference to the appended drawings, in which:

FIG. 1 shows a top isometric view of one form of the invention;

FIG. 2 shows an isometric view of a tool usable with invention;

FIG. 2B shows an isometric view of the ratchet pawl and tool engagement link;

FIG. 5 shows an isometric view of a further form of tool;

FIG. 5B shows an isometric view of an alternative construction of the ratchet pawl and tool engagement link;

FIG. 6 shows a diagrammatic view of the engagement of the components of FIG. 5A and FIG. 5B; and FIG. 6B shows a diagrammatic view of the disengagement of the components of FIG. 5A and FIG. 5B;

FIG. 6C shows a cross-section taken along the lines 6C—6C of FIG. 6A.

DESCRIPTION OF THE PREFERRED EMBODIMENT

Figure 3A:
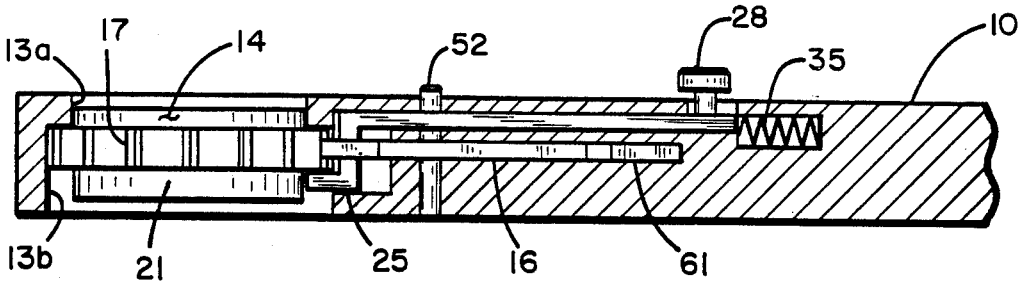
FIG. 3A shows a partial elevational cross-sectional view.

Referring first to FIG. 1, a preferred embodiment of the invention is shown in isometric view. In this view, handle drive mechanism 10 is shown without a corresponding tool attached thereto. Handle drive mechanism 10 includes a handle 11 and at least one head 12. The preferred embodiment of the invention is described herein with reference to a single head 12 proximate an end of handle 11, but it is to be understood that the invention could equally well be constructed having two heads, one proximate each end of handle 11. This alternative embodiment is particularly adaptable in cases wherein a wide variety of tools is to be used with handle drive mechanism 10, for in this case different size bores may be made proximate respective ends of handle 11.

A stepped circular head bore 13 is constructed in head 12. Bore 13*a* is constructed of a predetermined first diameter, at the top of head 12, and a second larger bore 13*b* is constructed through the bottom of head 12. In one form of the preferred embodiment, handle drive mechanism 10 is constructed from a plurality of layers of sheet steel which are affixed together as by riveting or other fastening techniques. The individual steel sections which form the layers are shaped to provide for space for mounting and moving certain mechanical parts of the apparatus. Rivets 52 and 53 hold the respective layers of sheet steel together to form all of the functional components of handle drive mechanism 10.

A slidable release button 28 projects from one side of handle drive mechanism 10, and is mechanically linked to a slidable tool engagement link 25 which will be further explained hereinbelow. Tool engagement link 25 may be moved into projecting engagement in bore 13*b* and may be withdrawn therefrom, by sliding movement of release button 28.

FIG. 2A shows an isometric view of a tool 14 for use as a part of the invention. Tool 14 has a raised shoulder having a plurality of circumferential teeth 17 for engagement against a ratchet pawl 16 which is pivotal about rivet 52, as shown in FIG. 2B. Ratchet pawl 16 has an ear 15*a* and a second ear 15*b*, either of which are engageable against and between teeth 17 for the proper ratcheting action. Pawl 16 has a pair of projecting tabs 18*a* and 18*b*, either of which serves as a lever for enabling the pivoting motion of pawl 16 about rivet 52 to engage either ear 15*a* or 15*b* against teeth 17.

Tool 14 is of generally cylindrical construction, having an upper cylindrical portion comprising a rotational bearing surface 20 and a lower cylindrical portion comprising a rotational bearing surface 21, and having an intermediate raised circumferential shoulder with a plurality of teeth 17. Bearing surface 20 is engageable into bore 13*a* for relatively close fitting therein. Bearing surface 21 is engageable by tool engagement link 25, in its forward position. The inside surface 22 of nut drive tool 14 is formed into a circumferential arrangement of flats of proper size to engage against standard nut and bolt dimensions. Surface 22 may have a general hexagon pattern for grasping nuts and bolts in the conventional manner, or it may have any of a number of conventional shapes typically used in wrenches of this type for grasping and rotating nuts and bolts. Typically, a plurality of tools 14 are constructed for use with a single handle drive mechanism 10, each of the plurality of tools 14 being sized internally at surface 22 to accommodate a different standard size nut or bolt. Size selections may be made in any convenient manner, and may include standard S.A.E. wrench sizes as well as metric sizes.

FIG. 3A shows an elevation view of handle drive mechanism 10 in partial cross section, with tool 14 engaged in an operative manner. Tool engagement link 25 is in a forward position, in slidable contact against lower bearing surface 21. Tool 14 is retained within bore 13*a* and 13*b* by means of the intermediate shoulder having teeth 17. Bore 13*a* is sized smaller than the shoulder, thereby preventing tool 14 from passing through the top of the bore. Bore 13*b* is sized slightly larger than the shoulder, but tool engagement link 25 prevents tool 14 from passing through the bottom of the bore. A spring 35 biases tool engagement link 25 forwardly into engagement against tool 14.

Figure 3B:
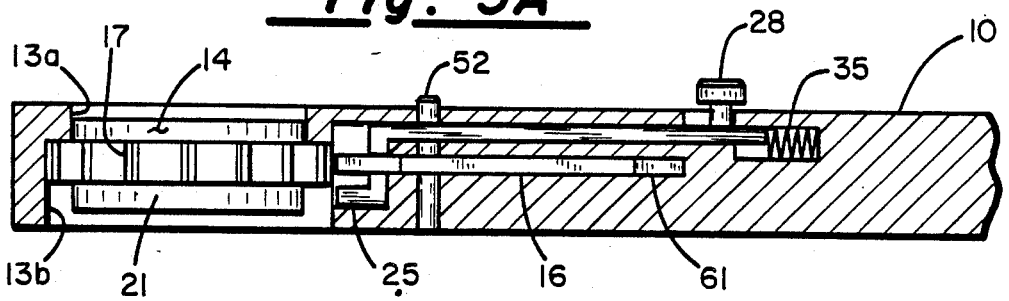
FIG. 3B shows the view of FIG. 3A with the tool engagement link disengaged.

FIG. 3B shows the same view as FIG. 3A, with tool engagement link 25 retracted, by slidable movement of release button 28 rearwardly. Spring 35 is compressed, and the forward lip of tool engagement link 25 is pulled rearwardly to provide clearance for tool 14 to pass through the bottom of bore 13*b*. In this position tool 14 may be readily removed from handle drive mechanism 10.

Figure 4A:
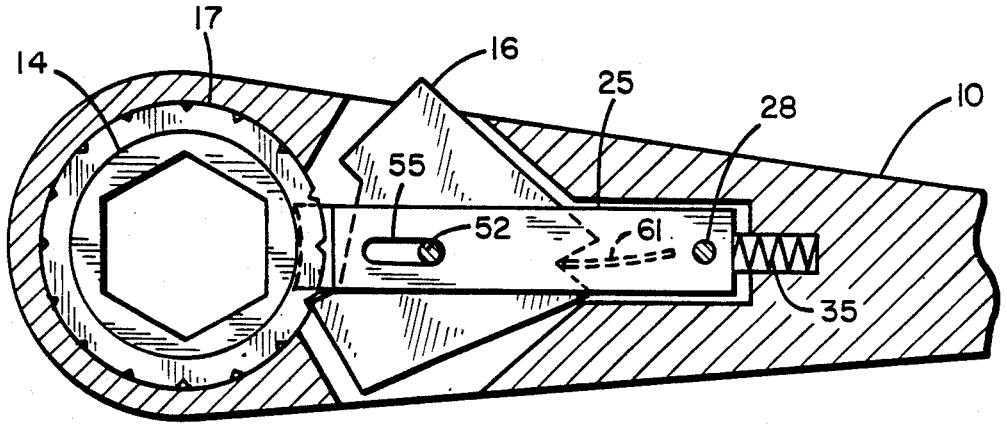
FIG. 4A shows a cross-sectional view taken along the line 4—4 of FIG. 1.
Figure 4B:
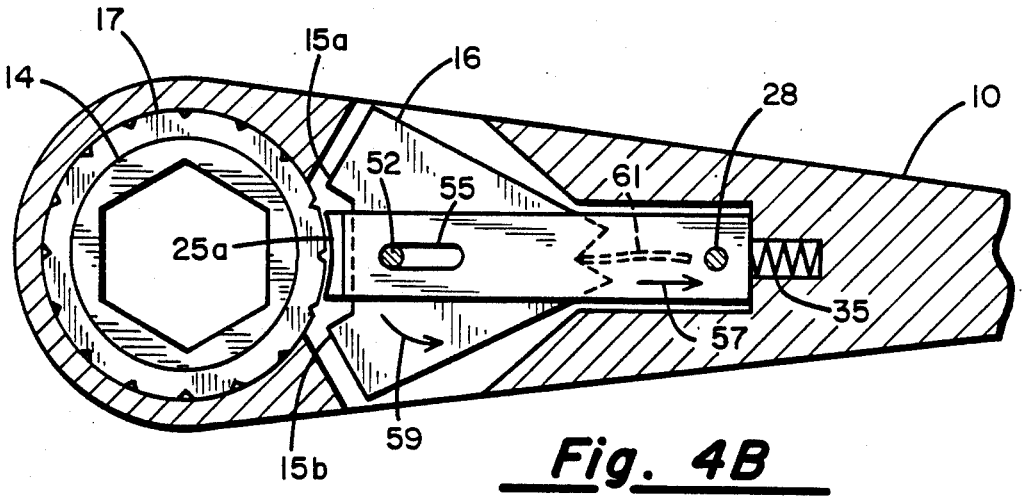
FIG. 4B shows the view of FIG. 4A with the tool engagement link disengaged.

FIG. 4A shows a view taken along the lines 4—4 of FIG. 1, with ratchet pawl 16 in engagement against teeth 17. In this position the handle drive mechanism 10 and tool 14 may be operated to exert turning force against a bolt or the like. Ratchet pawl 16 is coupled to an over-center spring 61 which biases ratchet pawl 16 toward either of two fixed positions, with an ear engaged into teeth 17. Tool engagement link 25 has an elongated slot 55 to permit sliding movement of tool engagement link 25 relative to rivet 52. FIG. 4B shows the same view as FIG. 4A, with tool engagement link 25 moved rearwardly as shown by arrow 57. Rearward motion of tool engagement link 25 causes corresponding rearward motion of the front lip 25*a*, which is a part of tool engagement link 25. Front lip 25*a* engages against the forward edge of ratchet pawl 16, thereby causing ratchet pawl 16 to pivot about rivet 52 in the direction shown by arrow 59. This pivoting motion releases the ratchet pawl ears 15*a* and 15*b* from engagement against teeth 17, and at the same time disengages front lip portion 25*a* from engagement against lower bearing surface 21 of tool 14. All of these disengagements are caused by the single rearward motion of tool engagement link 25, thereby permitting tool 14 to pass freely from handle mechanism 10 without interference.

FIG. 5A shows an alternative form of tool 114 which may be used with handle drive mechanism 10. Tool 114 has a projecting shank 113, which may be adapted for coupling to commercially available socket wrenches of various sizes. Tool 114 has a first bearing surface 121 which is engageable into the smaller diameter bore of handle drive mechanism 10, a raised shoulder 118 with circumferential teeth 117, and a second bearing surface 120 which may be engaged by a suitable tool engagement link. FIG. 5B shows an alternative construction of a ratchet pawl and tool engagement link, with dotted lines showing the engagement fit against tool 114 of FIG. 5A. Tool engagement link 125 has a forward curved edge 125*a* which is mated to bearing surface 120. Ratchet pawl 116 is pivotally mounted in handle mechanism 10 about rivet 152. Ratchet pawl 116 has affixed thereto a pair of projecting studs 119 and 128. Studs 119 and 128 may be engaged by projecting shoulders 129 and 138 respectively, when tool engagement link 125 is slidably moved rearwardly. A slot 155 permits sliding movement of tool engagement link 125, which preferably is implemented by means of a projecting release button 130.

FIGS. 6A and 6B show a diagrammatic view of the engagement of the linkage of FIG. 5B against a tool 14. In its normal position, tool engagement link 125 is forwardly biased as shown in FIG. 6A, wherein the front curved edge 125*a* is seated against bearing surface 120. One of the ears of ratchet pawl 116 is engaged against teeth 117. FIG. 6B shows the linkage of FIG. 6A, after tool engagement link 125 has been moved slidably rearwardly. If force is applied against release button 130 in the direction indicated by arrow 160, tool engagement link 125 will slide rearwardly against the force of a compression spring (not shown). This causes the shoulders 138 and 129 to also slide rearwardly, coming into contact against either stud 119 or 128. This contact causes ratchet pawl 116 to pivot about rivet 152, thereby releasing both ears of ratchet pawl 116 from contact with the teeth of tool 14. In the position shown in FIG. 6B both the tool engagement link 125 and the ratchet pawl 116 are completely disengaged from tool 14, thereby permitting tool 14 to be readily removed from the bores in handle mechanism 10.

In operation, the apparatus is preferably utilized in combination with a plurality of different size tools 14, each of which may be adapted for different size fasteners. Alternatively, the plurality of tools 14 may be adapted with construction of various projecting shanks, instead of the internal shaped surface 22, so as to engage the commonly used wrench socket available in commerce. A wide variety of sizes and shapes are possible for utilization in combination with handle drive mechanism 10, and regardless of the particular tools selected the operation proceeds as described herein. A tool 14 may be inserted into handle drive mechanism 10 by merely sliding release button 28 rearwardly. This opens the bores 13*a* and 13*b* to enable the tool 14 to be easily inserted into handle drive mechanism 10. When button 28 is released the force of spring 35 causes tool engagement link 25 to become seated against the lower bearing surface 21 of tool 14, and holds tool 14 into the handle drive mechanism 10 for operation. To remove tool 14 from the wrench, button 28 is again pushed rearwardly against the force of spring 35. This causes tool engagement link 25 to pivot ratchet pawl 16 to a neutral position out of engagement with teeth 17, and at the same time opens the obstructions in bore 13*b* to permit tool 14 to drop free from handle drive mechanism 10.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In combination, a ratchet wrench and removable tool comprising:

a handle member having a circular opening therethrough proximate an end of said handle member, said circular opening formed by two bores of different diameters;

an interior slot in said handle member, said slot opening into said circular opening;

a tool engagement link slidably movable in said slot, said link having a forward lip portion engageable into the one of said two bores having the larger diameter;

a pivotable ratchet pawl attached to said handle member, and spring means for engaging said pawl, said ratchet pawl having teeth engaging ears pivotable into said circular opening; and a tool comprising a first cylindrical portion sized to fit into the one of said two bores having the smaller diameter, and further comprising a raised cylindrical shoulder sized larger than the one of two bores having the smaller diameter and having a plurality of teeth thereabout, and further comprising a second cylindrical portion of smaller diameter than said cylindrical shoulder, said shoulder located intermediate said first and second cylindrical portions.

2. The apparatus of claim 1, further comprising a spring member in said interior slot, for biasing said tool engagement link toward said circular opening.

3. The apparatus of claim 2, wherein said tool engagement link further comprises a projecting tab engageable against said ratchet pawl, said tab being positioned on said link for engagement against said ratchet pawl when said link is slidably moved to a rearward position.

4. The apparatus of claim 3, wherein said spring means further comprises over-center spring means for biasing one of said ratchet pawl teeth engaging ears toward said circular opening.

5. The apparatus of claim 1, wherein said tool engagement link further comprises at least one projecting shoulder and said ratchet pawl further comprises at least one projecting stud positioned to be engageable by said shoulder.

6. The apparatus of claim 5, further comprising a spring member in said interior slot, for biasing said tool engagement link toward said circular opening.

7. The apparatus of claim 6, wherein said spring means further comprises over-center spring means for biasing one of said ratchet pawl teeth engaging ears toward said circular opening.

8. A ratcheting wrench adapted for receiving a removable tool having a toothed ratchet surface, comprising a handle member having a circular opening therethrough proximate an end, said opening having a first diameter bore through one side of said handle member and a larger second diameter bore through the other side of said handle member;

an interior slot in said handle member opening into said second diameter bore;

a pivotable ratchet pawl mounted in said handle, and spring means for urging said ratchet pawl into either of two pivotable positions, said ratchet pawl having at least one tooth-engaging ear pivotable into and out of said second diameter bore;

a tool engagement link slidably mounted in said interior slot, said link having a tab engageable into said second diameter bore; and means for spring biasing said tool engagement link toward said circular opening.

9. The apparatus of claim 8, further comprising a tool having a first cylindrical section adapted for fitting into said first diameter bore, a second intermediate circumferential shoulder having a plurality of teeth and sized for fitting into said second diameter bore, and a third cylindrical section of smaller diameter than said second shoulder.

10. The apparatus of claim 9, wherein said second shoulder and said third section are positioned to be respectively alignable with said at least one ratchet pawl ear and said tool engagement link tab.

11. The apparatus of claim 10, further comprising over-center spring means for pivoting said ratchet pawl toward either of two positions.

* * * * *